US006429377B1

(12) United States Patent
Polasky

(10) Patent No.: US 6,429,377 B1
(45) Date of Patent: Aug. 6, 2002

(54) HIGH TEMPERATURE WIRE CONSTRUCTION

(75) Inventor: Dan Polasky, Chagrin Falls, OH (US)

(73) Assignee: Electrovations, Inc., Aurora, OH (US)

( * ) Notice: Subject to any disclaimer, the term of this patent is extended or adjusted under 35 U.S.C. 154(b) by 20 days.

(21) Appl. No.: 09/652,439

(22) Filed: Sep. 1, 2000

Related U.S. Application Data

(62) Division of application No. 09/365,269, filed on Jul. 30, 1999, now Pat. No. 6,249,961.

(51) Int. Cl.[7] ..... H01B 7/00
(52) U.S. Cl. ..... 174/124 R
(58) Field of Search ..... 174/121 R, 122 R, 174/122 G, 124 R, 124 G; 428/388, 389

(56) References Cited

U.S. PATENT DOCUMENTS 2,227,931 A * 1/1941 Greenleaf ..... 174/122 R
4,598,018 A * 7/1986 Beuscher ..... 174/124 R X
5,274,196 A * 12/1993 Weinberg ..... 174/121 R
5,468,915 A * 11/1995 Green ..... 174/124 R

* cited by examiner

*Primary Examiner*—Chau N. Nguyen
(74) *Attorney, Agent, or Firm*—Daniel A. Thomson; Roger D. Emerson; Emerson & Skeriotis

(57) ABSTRACT

A wire capable of operating at high temperatures and a method of making the same is disclosed. The high temperature wire includes fiberglass, which surrounds the conductor. The fiberglass insulates the conductor and enables it to operate at relatively high temperatures. The fiberglass is heat-treated without any additional, or in lieu of, other chemical treatment and is sufficiently frangible to be easily removable from the conductor. The frangible fiberglass may be easily stripped away from the conductor without leaving strands which need to be individually removed.

2 Claims, 9 Drawing Sheets

HIGH TEMPERATURE WIRE CONSTRUCTION

This application is a divisional application of Ser. No. 09/365,269, HIGH TEMPERATURE WIRE CONSTRUCTION, filed Jul. 30, 1999, now U.S. Pat. No. 6,249,961, issued Jun. 26, 2001.

BACKGROUND OF THE INVENTION

1. Field of Invention

This invention pertains to the art of methods and apparatuses for providing electrical conductors encompassed by a layer of fiberglass to provide high temperature operating capability, and more specifically to methods and apparatuses for providing insulated electrical conductors for which the fiberglass, in close proximity to the conductor, is heat-treated to render the fiberglass sufficiently frangible to enhance the strippability of the fiberglass.

2. Description of the Related Art

It is well known to use fiberglass in the fabrication of high temperature electrical wires and cables. Fiberglass is used to encase a conductor material, as an electrical insulation, because it can withstand high temperatures. Fiberglass has a softening point above 800° C. Additionally, fiberglass is flexible and comes in the convenient forms of filaments, yarn strands, woven cloths, braided cloths, tapes, and sleeves.

It has also been the practice to impregnate fiberglass electrical insulation with high temperature binders, varnishes, and resins of various kinds and types improve electrical insulation properties and resistance to moisture. Characteristically, they tend to stiffen the insulated conductor or cable.

In some instances, high temperature resistant electrical insulation combine mica with fiberglass to provide resistance to temperatures of 450° C. or higher. The mica may be bonded to the fiberglass by any means known to be of sound engineering judgment. For example, hard and non-plyable resinous compositions may be used to bond the mica to the fiberglass. U.S. Pat. No. 3,629,024, which is incorporated herein by reference, discloses the foregoing methods to incorporate mica into the fiberglass for high temperature applications.

It is thus obvious that numerous methods and apparatuses have been developed to produce electrical conductors that operate at high temperatures. And, as mentioned above, it is generally well known that fiberglass alone, or fiberglass in conjunction with other materials such as mica, has been used to produce insulation for high temperature wire products. However, high temperature electrical conductors utilizing fiberglass have an inherent difficulty in that the fiberglass may be difficult to strip away from the wire. Untreated fiberglass when stripped away, leaves filaments and rough edges.

Fiberglass is difficult to strip away from the electrical conductor because of its long, soft, fibrous nature. Additionally, tools used to strip layers of material away from the electrical conductor are typically sized so that they do not contact the conductor itself. This is commonly done so that the conductor itself is not crimped or damaged during the stripping process. Consequently, the fiberglass closest to the electrical conductor is not cut. This results in a time consuming process wherein these remaining fibers must be removed individually.

The fact that fiberglass is difficult to strip is a serious problem because frequently the conductor needs to be exposed by removing the protective layers which surround it. This is typically done so that lengths of the conductive wires or cables may be coupled together. Alternatively, the layers covering the electrical conductor may need to be stripped away so that the conductor may be attached to a particular device or power supply. Thus, fiberglass which is difficult to strip away from the electrical conductor creates a time consuming and expensive difficulty.

Thus, it would be desirable to have a high temperature electrical conductor encased in fiberglass that can be completely and easily stripped away from the conductor itself. The current invention provides fiberglass that can be used to create high temperature electrical conducting products, but which is sufficiently frangible so that it may be easily removed from the conductor. The current invention also provides a method to make this frangible fiberglass.

It should be noted, however, that an insulated conductor comprising an easily strippable fiberglass does exist in the related art. However, unlike the invention disclosed in the current application, the fiberglass in this known insulated conductor must be chemically treated before it may be easily removed from the conductor. This is disclosed in U.S. Pat. No. 5,468,915 ('915 patent), which is incorporated herein by reference.

The '915 patent discloses that the fiberglass is treated with a chemical such as sodium silicate so that the fiberglass may be more easily removed from the conductor. As shown in FIGS. 2 and 4, the chemical reacts with the fiberglass, causing the fiberglass to become sufficiently frangible to break, and thus eliminating stringing when the fiberglass is stripped away from the conductor. Additionally, according to the '915 patent, heat treating the chemically treated fiberglass accelerates the chemical reaction and causes the fiberglass to more quickly become sufficiently frangible.

As shown in FIG. 4 of the '915 patent, the strands are passed through a pool of the sodium silicate prior to being disposed upon the conductor. Subsequently, further layers of fiberglass are wound onto these treated strands of fiberglass. The treated strands of fiberglass operate to transfer some of the sodium silicate solution to these outer layers. Finally, according to the '915 patent, heating the insulated conductor at a temperature of about 600° F. for about 1.5 minutes produces the most desirable results.

Consequently, after the chemically treated fiberglass of the insulated conductor, of the '915 patent, is heat-treated, all of the layers of fiberglass may be easily stripped away from the conductor. With the foregoing combined chemical and heat treatments, the fiberglass is rendered sufficiently frangible so that it may be removed from the conductor without having the tendency to leave strands of fiberglass that need to be individually removed.

The current invention improves upon the '915 patent in that it does not require the fiberglass to be chemically treated. Rather, the current invention produces frangible fiberglass that is easily removable from a conductor simply by heat treating the fiberglass layers.

Difficulties inherent in the related art are therefore overcome in a way that is simple and efficient while providing better and more advantageous results.

SUMMARY OF THE INVENTION

In accordance with one aspect of the current invention, the electrical conductor is wrapped with fiberglass and then heated to the devitrification temperature of the fiberglass.

In accordance with another aspect of the present invention, the fiberglass wrapped electrical conductor is not chemically treated.

Yet another aspect of the current invention includes a method of producing heat-treated fiberglass wrapped electrical conductor.

One advantage of the present invention is that it is easy to manufacture and can be made economically.

Another advantage of the present invention is that an electrical conductor, capable of operating at high temperatures, is produced wherein the layers on the conductor may be easily removed therefrom.

Yet another advantage of the current invention is that frangible fiberglass can be produced with fewer materials and using fewer procedures.

Another advantage of the current invention is the frangible fiberglass layer heat set around the conductor allowing for immediate application of insulation enhancing coatings and or binding agents.

An unexpected advantage that wire made with a heat set glass layer exhibits is dramatically reduced glass fly and dust that normally results during the insulation removal process necessary to terminate wire.

Another unexpected advantage of the current invention is a 100% to 150% increase in insulation strength as measured by insulation resistance testing at 900° F. over wire manufactured by the process in the '915 patent.

Another advantage of the current invention is a 200% to 300% improvement in current leakage performance at 90% relative humidity as compared to wire manufactured by the process in the '915 patent.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 9:
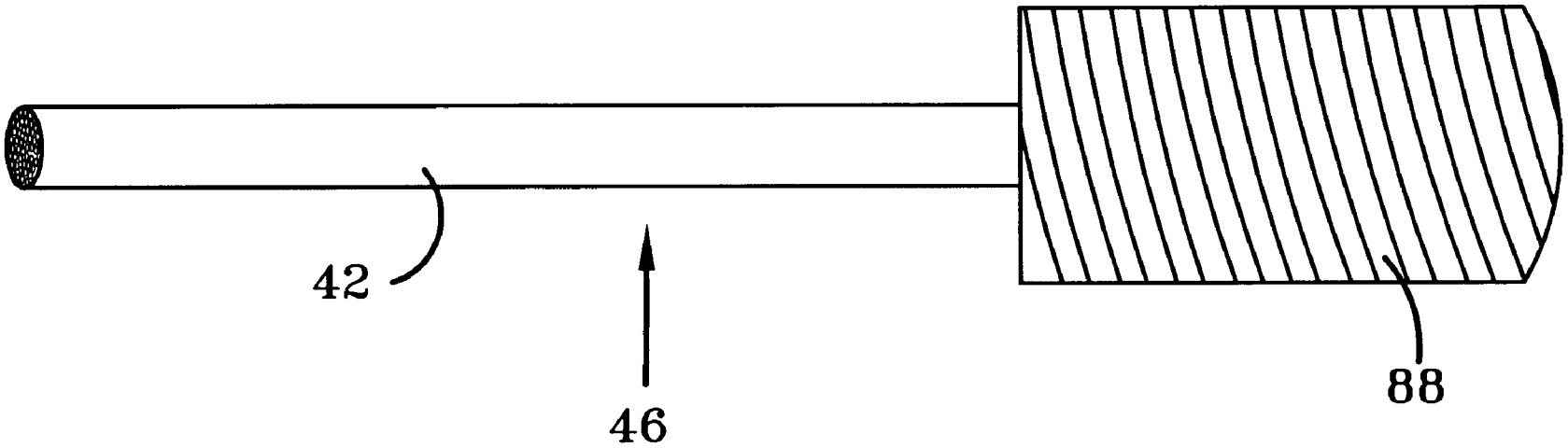
FIG. 9 is a cut away perspective view of the finished wire subassembly showing the conductor under the treated flangible fiberglass layers.

Referring now to the drawings, which are for purposes of illustrating a preferred embodiment of the invention only and not for purposes of limiting the same, FIG. 9 shows an electrical conductor 46 (i.e. finished subassembly) capable of operating at high temperatures. The finished subassembly 46 comprises essentially a conductor 42 and a layer of fiberglass 88. The conductor 42 is made of a material having highly conductive electrical properties. For example, conductor 42 may be made out of copper or carbon as well as any other materials known to those skilled in the art of electrical wire construction. In the preferred embodiment, the conductor 42 is made of a 27% Nickel-coated copper. It is to be understood that the percentage of Nickel coating is simply a preferred embodiment and any percentage of Nickel coating can be used as long as chosen using sound engineering judgment.

The layer of fiberglass 88 surrounding the conductor 42 may be applied in any manner chosen using sound engineering judgment. Preferably, the layer of fiberglass 88 comprises strands of fiberglass wrapped around the conductor 42. The finished subassembly 46 has a fiberglass wrap 88, and has not been chemically treated. The finished subassembly 46 has simply been heat-treated to the devitrification temperature of the fiberglass. Devitrification is the process by which glass, or fiberglass, loses its glassy state and becomes crystalline. The devitrification temperature of fiberglass is typically about 1200° F. The finished subassembly 46 will be completed into a final wire construction by adding additional layers that might include a mica layer, additional fiberglass wrap or wraps, overall fiberglass braid or wrap, or coatings or extrusions of PTFE, ETFE, FEP, silicon rubber or other materials chosen using sound engineering judgment.

Figure 1:
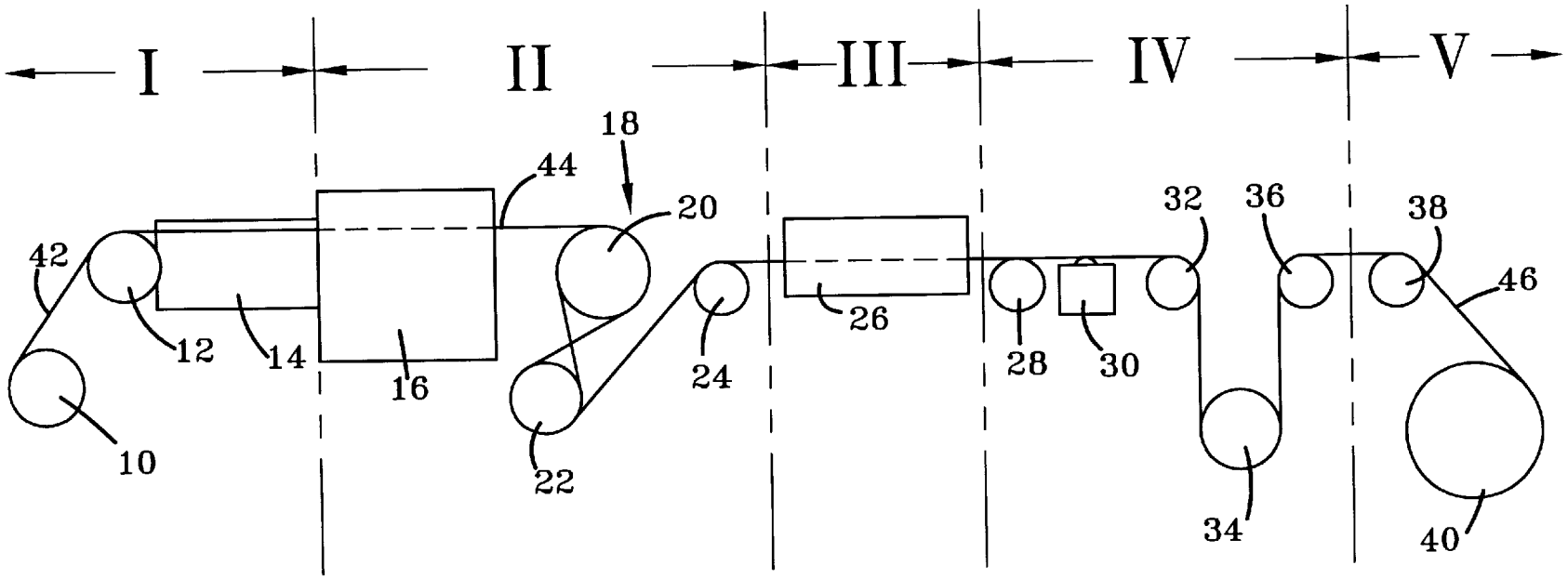
FIG. 1 is a diagram of the inventive process used for producing the heat-treated fiberglass wrapped electrical conductor.

With reference now to FIG. 1, the diagram shows the inventive process and assembly broken down into five sections, labeled as I, II, III, IV, and V. The diagram shown in FIG. 1 is merely a preferred embodiment of this invention, and is not intended to limit the invention in any way. The inventive process of heat-treating a fiberglass-wrapped conductor 44 can be carried out by any process using sound engineering judgment.

Figure 2:
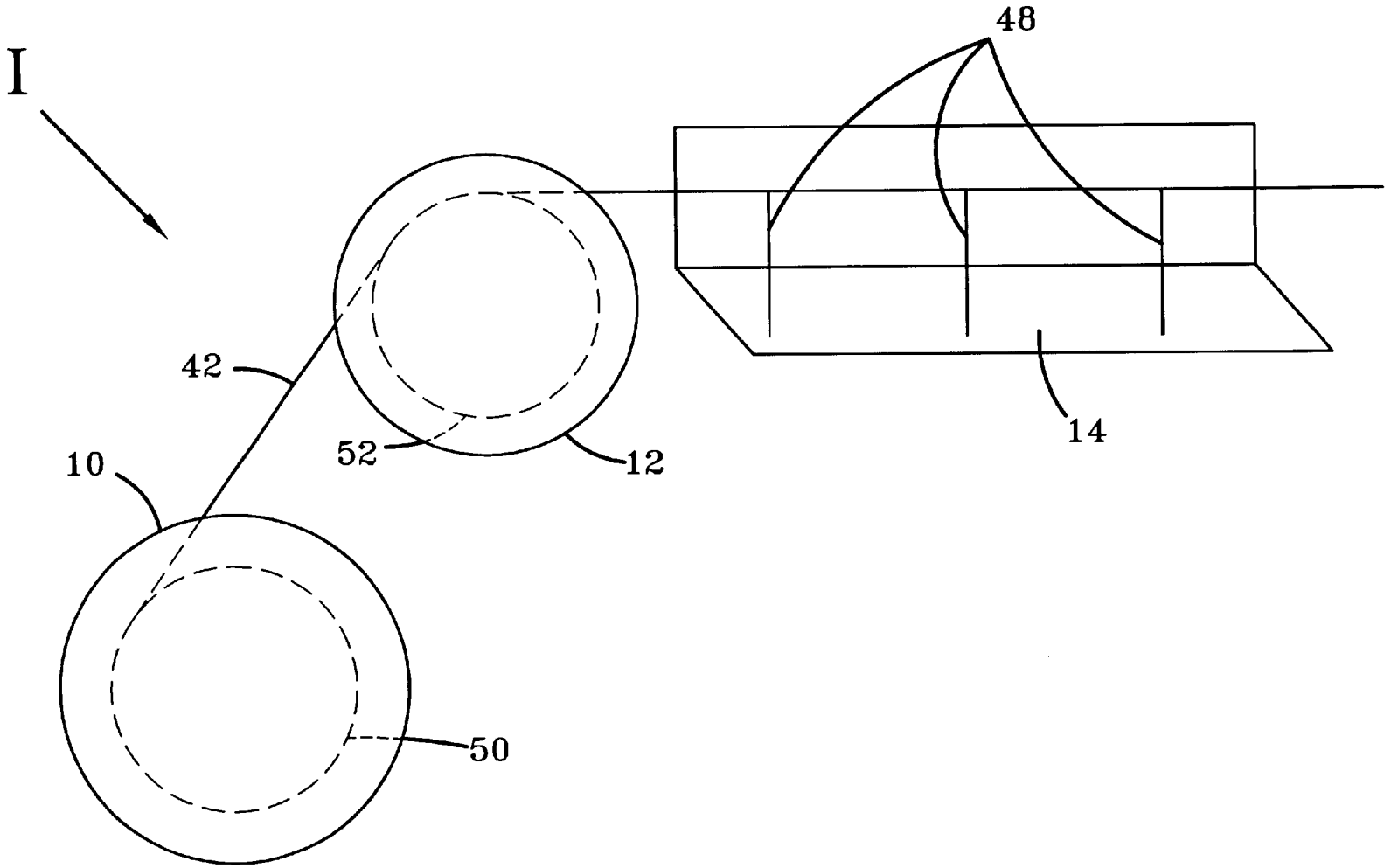
FIG. 2 is an exploded view of section I of FIG. 1, showing the conductor source, the untreated conductor, and the first pulley.

FIG. 2 shows an exploded view of section I, which is the starting point of the inventive process. FIG. 2 shows the conductor source 10 (preferably a spool as shown), with a conductor coil 50, having a conductor 42 wrapped thereon. The conductor 42, preferably a 27% Ni-coated copper, is drawn from the conductor coil 50 onto a first pulley channel 52 of first pulley 12. The untreated conductor 42 then travels across conductor guides 48 on a conductor guide frame 14. The conductor 42 then travels into the fiberglass wrapping device 16, which is shown in FIG. 3.

Figure 3:
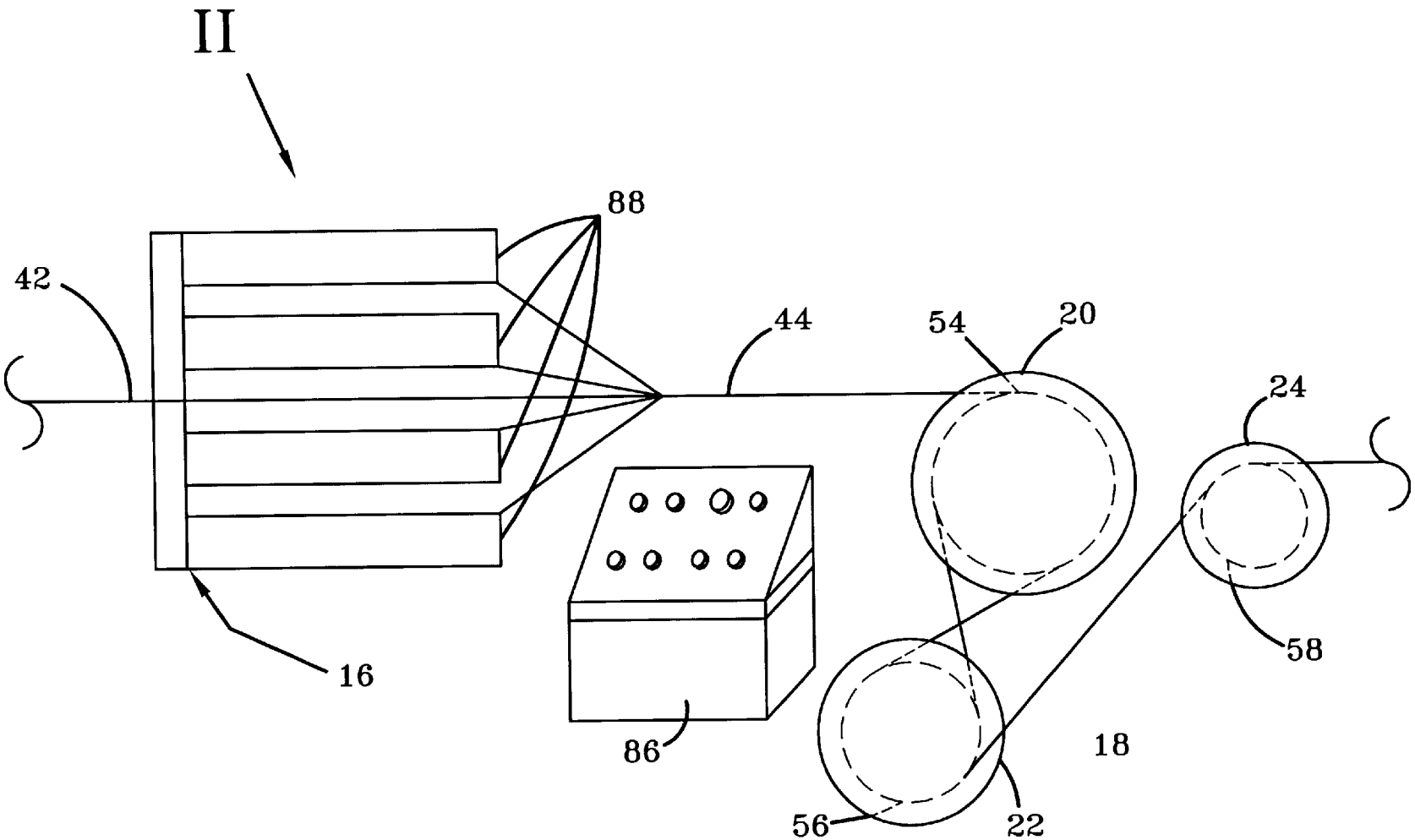
FIG. 3 is an exploded view of section II of FIG. 1, showing the fiberglass wrapping mechanism, the fiberglass-wrapped conductor, the figure-eight capstan pulleys, and the control panel.

FIG. 3 shows an exploded view of section II, which consists of the fiberglass wrapping device 16, for wrapping the fiberglass 88 around the conductor 42, a control panel 86, for controlling the inventive process, a fiberglass wrapped conductor 44, a figure-eight speed regulating capstan 18 consisting of a second pulley 20 and a third pulley 22, and a fourth pulley 24. The conductor 42 receives a wrap of fiberglass 88, as shown in FIG. 9, and then comes out as a fiberglass wrapped conductor 44. It is also a part of this invention to wrap the fiberglass 88 onto the conductor 42 in any manner chosen using sound engineering judgment.

The fiberglass wrapped conductor 44, shown in FIG. 3, then travels onto the figure-eight speed regulating capstan 18, by traveling around second pulley channel 54 of the second pulley 20 and therefrom onto third pulley channel 56 on the third pulley 22. The figure-eight speed regulating capstan 18 helps maintain a consistent speed of the fiberglass wrapped conductor 44 by maintaining a consistent tension on the fiberglass wrapped conductor 44. The fiberglass wrapped conductor 44 then travels from the third pulley channels 56 to a fourth pulley channel 58 on the fourth pulley 24. From the fourth pulley channel 58 on FIG. 3, the fiberglass wrapped conductor 44 then proceeds to the burner 26 as shown in FIG. 4, which shows an exploded view of section III.

Figure 4:
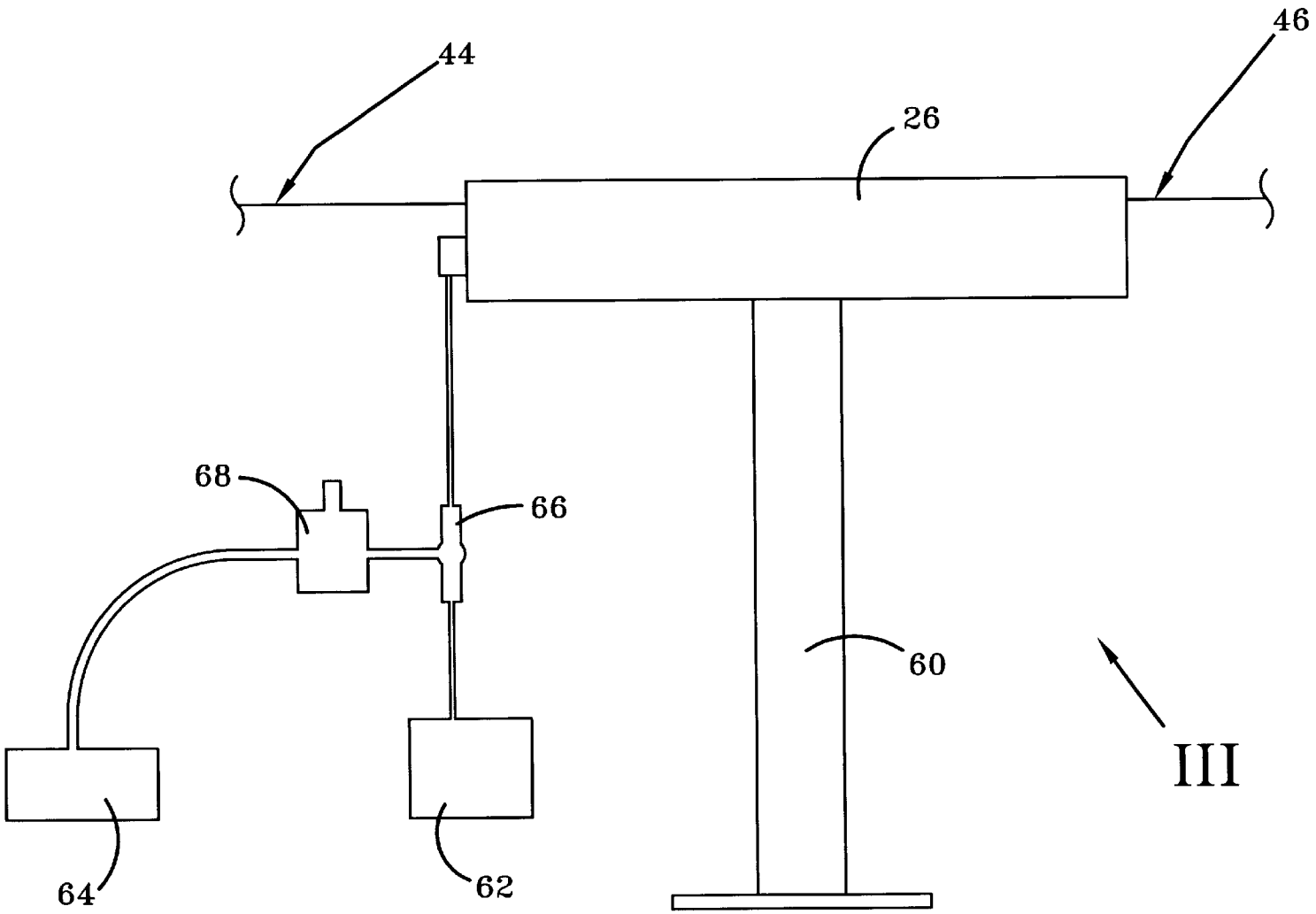
FIG. 4 is an exploded view of a section III showing the burner, the gas source, and the air source.

FIG. 4 shows the burner 26, a burner stand 60, an air source 62, a gas source 64, a fuel injector 66, and a solenoid valve 68. In the preferred embodiment, the burner 26 can be any type of ribbon burner, such as the one produced by Ensign Ribbon Burners Inc. In the most preferred embodiment, the burner 26 is a high intensity, over air gas burner using natural gas and air from the factory (not shown) and a zero pressure regulator (not shown). The operation of the burner 26, the solenoid valve 68, and the fuel injector 66 are well known in the art, and, for the sake of brevity, will not be described herein. The fiberglass wrapped conductor 44 travels through the burner 26 at a specific rate of velocity, and is heated to approximately 1200° F. In the preferred embodiment, the fiberglass wrapped conductor 44 is treated in the burner 26 for approximately 4 seconds. In the burner 26, during the heating process, the fiberglass wrap 88 undergoes the process of devitrification, which in the past was something to be avoided. The devitrification process involves the fiberglass 88 losing its glassy state and becoming crystalline and heat set around the conductor, thereby increasing the strippability of the fiberglass 88. The process of devitrification is well known in the art, and the process will not be described in detail. In the most preferred embodiment, the burner 26 uses a relatively short length high intensity natural gas flame, which heats primarily the fiberglass wrap 88, and does not significantly effect the conductor 42. The burner 26 described above is only a preferred embodiment of the invention and is not intended to limit the invention in any way. Any burner 26 may be used to heat the fiberglass 88, as long as chosen using sound engineering judgment. Once a finished subassembly 46 emerges from the burner 26, the finished subassembly 46 proceeds to a fifth pulley 28, as shown in FIG. 5.

Figure 5:
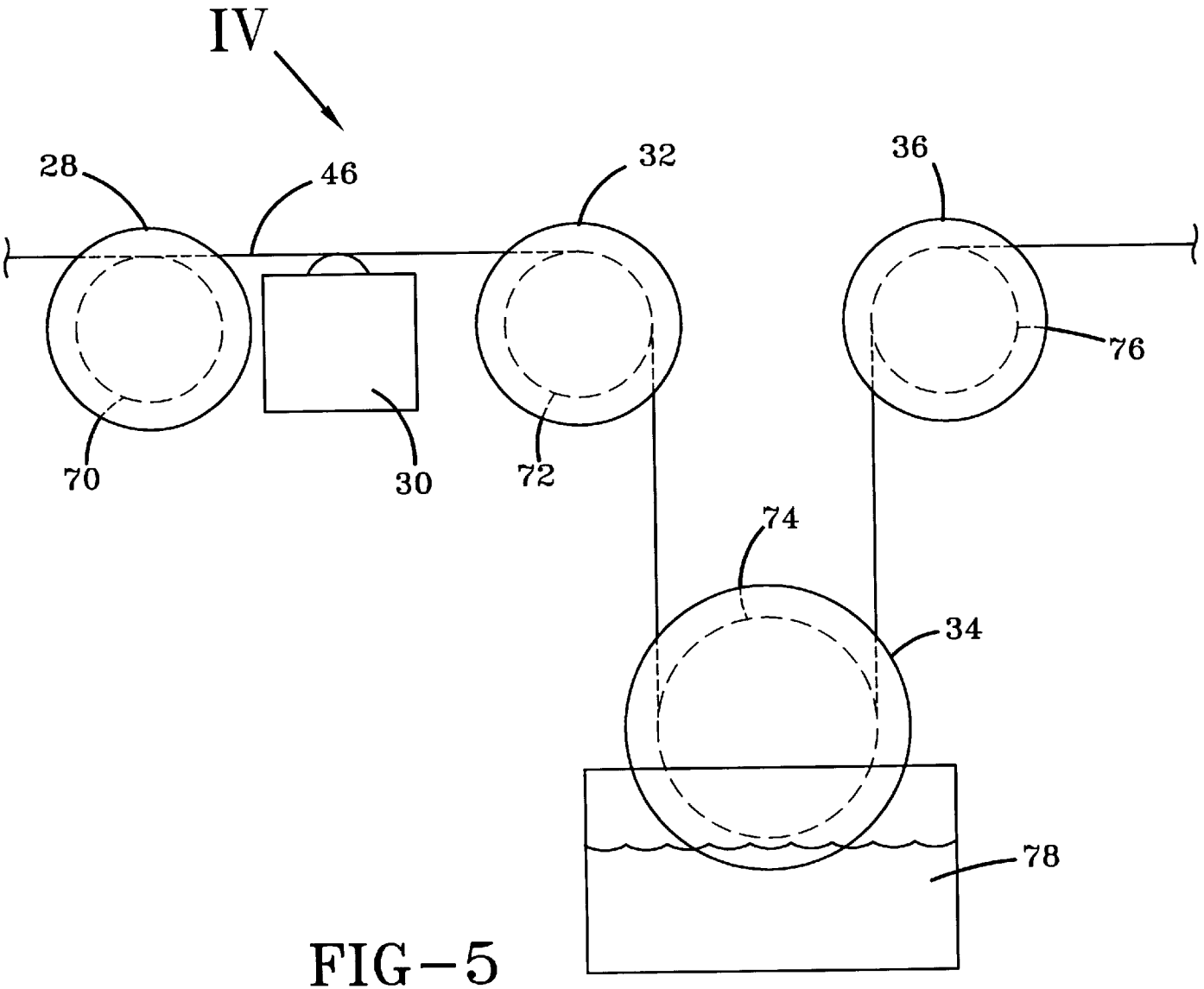
FIG. 5 is an exploded view of section IV of FIG. 1, showing the fifth pulley, the insulation enhancing coating, the sixth pulley, and the eighth pulley.

FIG. 5 shows an exploded view of section IV, which consists of the fifth pulley 28, a water cooler 30, a sixth pulley 32, a seventh pulley 34, an eighth pulley 36, and a bonding agent 78. The finished subassembly 46 travels over a fifth pulley channel 70 and onto the cooler 30, which cools the finished subassembly 46. The finished subassembly 46 then travels onto a sixth pulley channel 72 on the sixth pulley 32, and then down into the bonding agent 78. The insulation enhancing coating and/or bonding agent 78, which in the preferred embodiment is a silicon solution, can be any conventional bonding agent chosen using sound engineering judgment. The bonding agent 78 prevents the recently applied fiberglass wrap 88 from peeling off of the conductor 42, improves the electrical insulation properties, and allows the finished subassembly 46 to processed in succeeding manufacturing steps. The finished subassembly 46 wraps around the seventh pulley channel 74 on the seventh pulley 34. The seventh pulley 34 is immersed in the bonding agent 78, so when the finished subassembly 46 travels around seventh pulley 34, the product 46 is coated with the bonding agent 78. From the seventh pulley channel 74, the finished subassembly 46 then travels up to an eighth pulley channel 76 on the eighth pulley 36. From there, the finished subassembly 46 travels to a ninth pulley 38, which is shown in FIG. 6.

Figure 6:
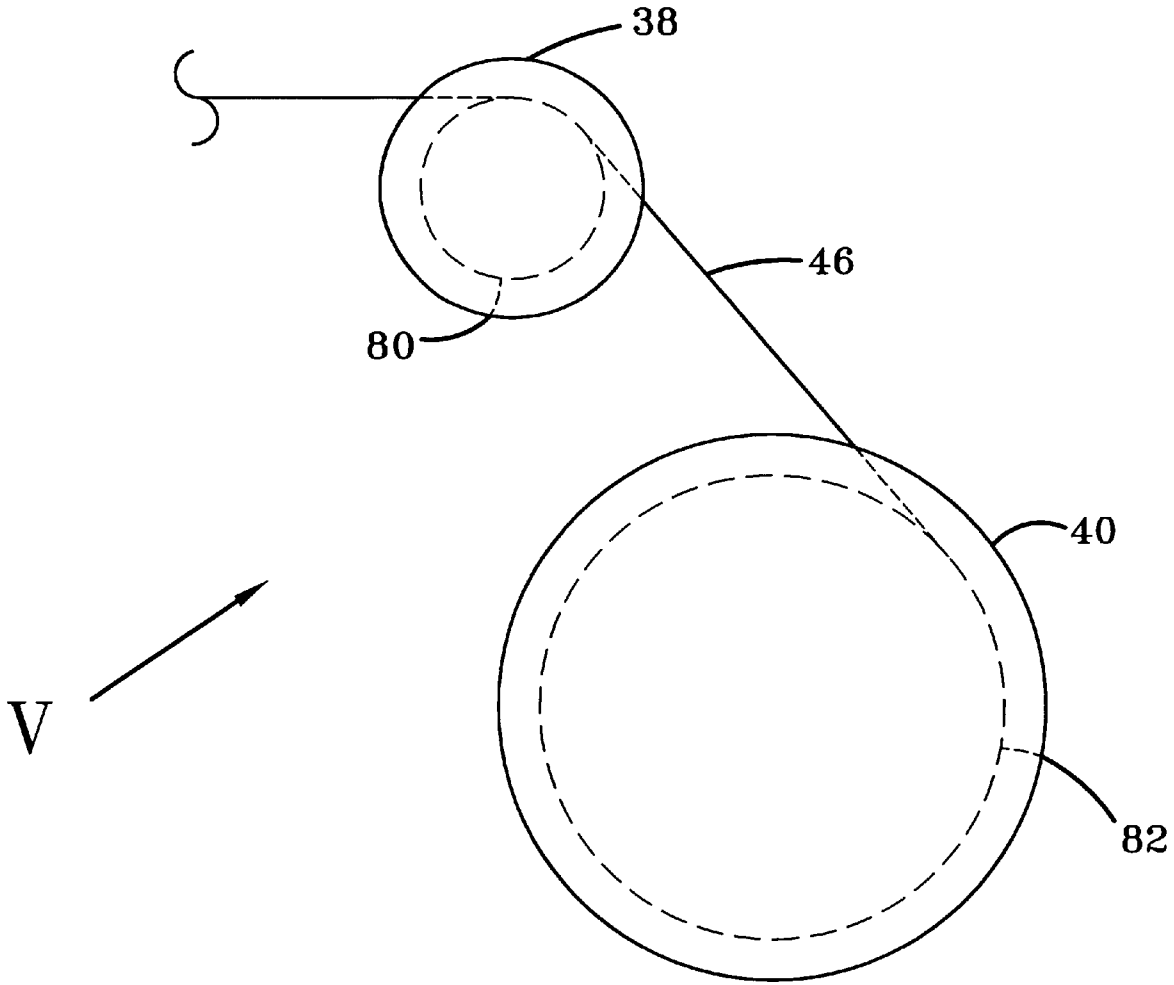
FIG. 6 is an exploded view of section V of FIG. 1, showing the ninth pulley, the treated product, and the treated product spool.
Figure 7:
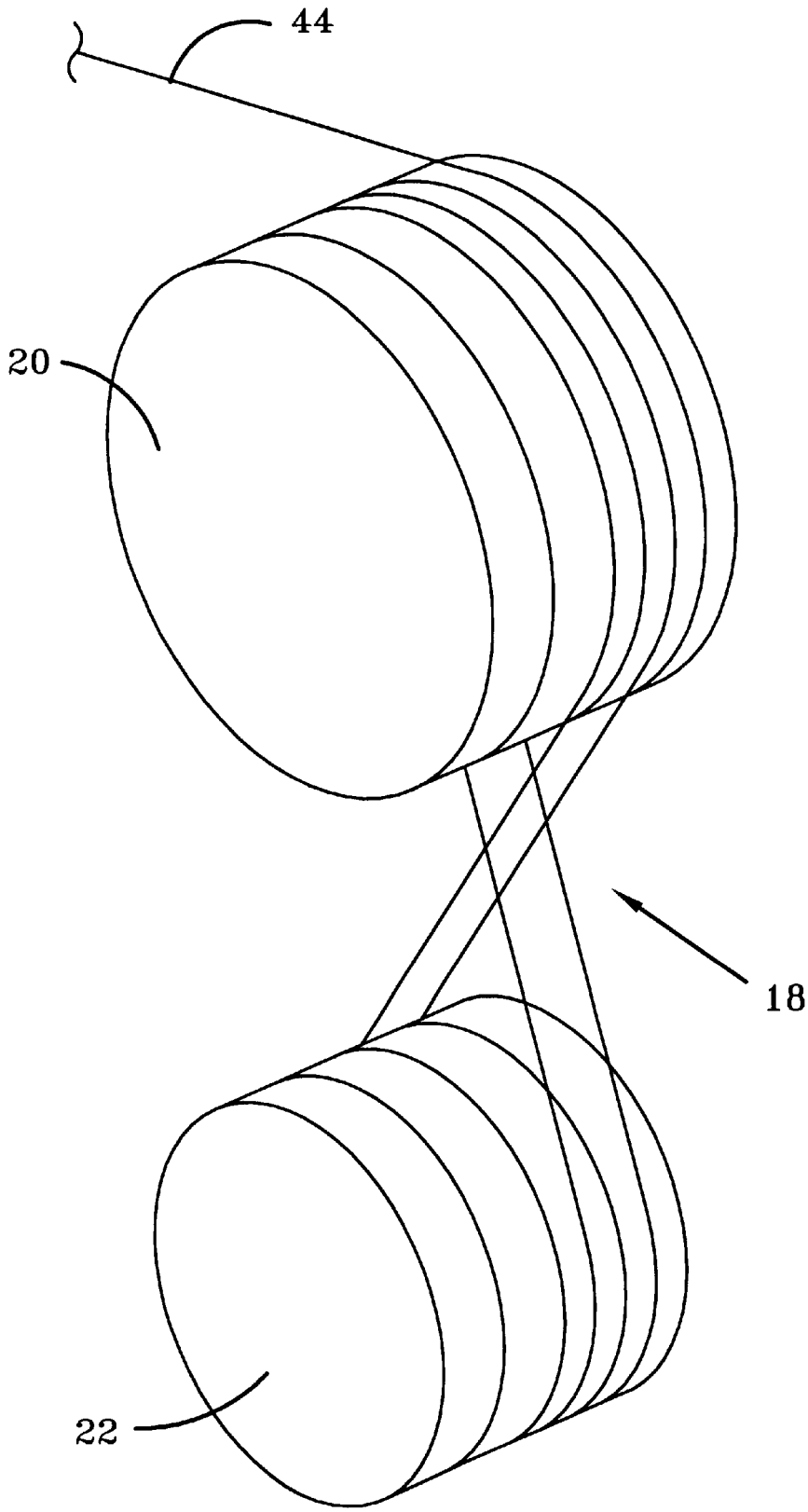
FIG. 7 is an exploded perspective view of the figure-eight capstan pulleys.
Figure 8:
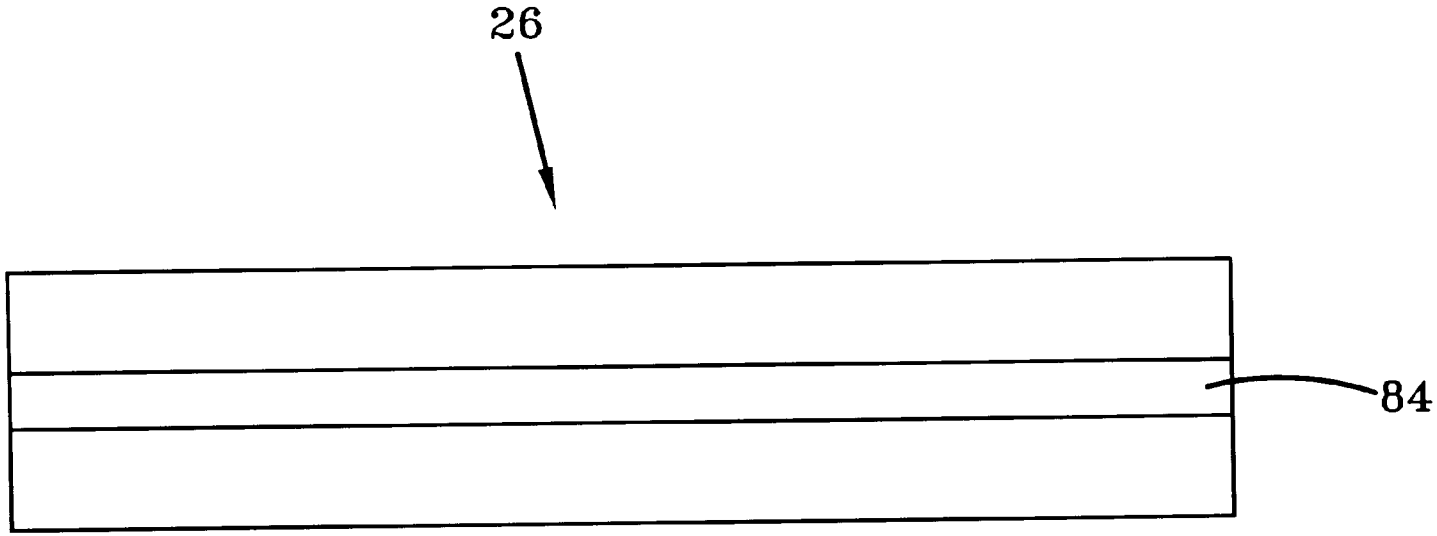
FIG. 8 is a top view of the burner showing the burner port.

FIG. 6 shows an exploded view of section V, which consists of the ninth pulley 38, a ninth pulley channel 80, a finished subassembly spool 40, and a finished subassembly coil 82. The finished subassembly 46 travels across the ninth pulley channel 80 and is wrapped around the finished subassembly coil 82.

The process described herein is merely a description of the preferred embodiment and is not intended to limit the invention in any way. The conductor 42 can be wrapped with fiberglass 88 and heated to its devitrification temperature by any means chosen using sound engineering judgment.

Additionally, the elimination of the sodium silicate solution allows the introduction of an impregnation, which improves electrical performance and aids in the control of glass dust that results from the removal of the fiberglass insulation.

The invention has been described with reference to preferred embodiments. Obviously, modifications and alterations will occur to others upon a reading and understanding of this specification. It is intended to include all such modifications and alternations in so far as they come within the scope of the appended claims or the equivalents thereof.

Having thus described the invention, it is now claimed:

1. A non-chemically treated electrical conductor comprising:

at least one layer of fiberglass that has been heat-treated to the devitrification temperature of the fiberglass to enhance the strippability of the fiberglass from the non-chemically treated conductor.

2. The conductor of claim 1, wherein the fiberglass has been heated to a temperature of approximately 1200° F.

* * * * *